US006235158B1

(12) United States Patent
Dahl et al.

(10) Patent No.: US 6,235,158 B1
(45) Date of Patent: May 22, 2001

(54) SUCTION FORMING ROLL N DOUBLE SCREEN METHOD AND MACHINE FOR THE MANUFACTURE OF A FIBROUS MATERIAL WEB

(75) Inventors: Hans Dahl, Ravensburg; Gerhard Kotitschke, Steinheim; Volker Schmidt-Rohr, Heidenheim; Wilfried Kraft, Heidenheim; Hans-Jürgen Wulz, Heidenheim; Klaus Esslinger, Nattheim; Wolfgang Mayer, Heidenheim; Andreas Meschenmoser, Horgenzell, all of (DE); Gunther Mohrhardt, Sao Paolo (BR)

(73) Assignee: Voith Sulzer Papiermaschinen GmbH, Heidenheim (DE)

( * ) Notice: Subject to any disclaimer, the term of this patent is extended or adjusted under 35 U.S.C. 154(b) by 0 days.

(21) Appl. No.: 09/101,806

(22) PCT Filed: Dec. 17, 1997

(86) PCT No.: PCT/EP97/07094

§ 371 Date: Nov. 4, 1998

§ 102(e) Date: Nov. 4, 1998

(87) PCT Pub. No.: WO98/28489

PCT Pub. Date: Jul. 2, 1998

(51) Int. Cl.[7] ..... D21F 1/00

(52) U.S. Cl. ..... 162/203; 162/217; 162/300; 162/301

(58) Field of Search ..... 162/203, 217, 162/300, 301, 305

(56) References Cited

U.S. PATENT DOCUMENTS

| | | | | |
|---|---|---|---|---|
| 3,397,112 | | 8/1968 | Highton et al. | 162/318 |
| 4,024,015 | * | 5/1977 | Kankaanpaa | 162/357 |
| 4,124,441 | * | 11/1978 | Nykopp | 162/301 |
| 4,160,694 | * | 7/1979 | Futcher | 162/301 |
| 4,220,502 | | 9/1980 | Levänen | 162/273 |
| 4,234,382 | * | 11/1980 | Schiel | 162/301 |
| 4,443,297 | | 4/1984 | Cheshire et al. | 162/101 |
| 4,443,299 | | 4/1984 | Cheshire et al. | 162/101 |
| 4,443,300 | | 4/1984 | Bubik et al. | 162/306 |

(List continued on next page.)

FOREIGN PATENT DOCUMENTS

| | | |
|---|---|---|
| 4019593 | 1/1992 | (DE) . |
| 19634995 | 3/1998 | (DE) . |
| 0427691 | 5/1991 | (EP) . |
| 0489094 | 6/1992 | (EP) . |
| 0607549 | 7/1994 | (EP) . |
| 91/02842 | 3/1991 | (WO) . |

*Primary Examiner*—Karen M. Hastings
(74) *Attorney, Agent, or Firm*—Greenblum & Bernstein, P.L.C.

(57) ABSTRACT

A wet section (10) of a paper or cardboard machine and a process for the manufacture of a fibrous material web are suggested. The wet section (10) exhibits a double-screen segment (US), in which two screens (16, 18) are guided about parallel to one another and into which a fibrous material suspension (27) is introduced. The double-screen segment (US) is looped around a roll (22). The means (30, 32, 38) for the immobilization of the fibrous material suspension in the double-screen segment (US) are provided on the roll (22), for the formation of the fibrous material web. Moreover, the wet section exhibits means (32, 34, 36; 34, 36, 66) for further draining of the fibrous material web.

The roll (22) is thereby a combined forming and draining roll (22), which exhibits a forming sector (FS), on which the immobilization means (30, 32, 38) are arranged, as well as a draining sector (ES) located in the direction of the running screen behind the forming sector (FS), on which at least a predominant part of the draining means (32–36; 34, 36, 66) is arranged.

32 Claims, 6 Drawing Sheets

U.S. PATENT DOCUMENTS

| | | | | |
|---|---|---|---|---|
| 4,498,956 | | 2/1985 | Cheshire et al. | 162/101 |
| 4,790,909 | | 12/1988 | Harwood | 162/301 |
| 5,074,966 | | 12/1991 | Koivuranta | 162/301 |
| 5,135,614 | * | 8/1992 | Aula et al. | 162/217 |
| 5,389,206 | | 2/1995 | Bück et al. | 162/301 |
| 5,480,520 | | 1/1996 | Esslinger | 162/301 |
| 5,500,091 | | 3/1996 | Bück et al. | 162/301 |
| 5,695,612 | * | 12/1997 | Holopainen | 162/217 |
| 5,707,495 | | 1/1998 | Heinzmann et al. | 162/343 |
| 5,718,805 | | 2/1998 | Egelhof et al. | 162/301 |

* cited by examiner

SUCTION FORMING ROLL N DOUBLE SCREEN METHOD AND MACHINE FOR THE MANUFACTURE OF A FIBROUS MATERIAL WEB

BACKGROUND OF THE INVENTION

1. Field of the Invention

The invention relates to a wet section of a machine to manufacture a fibrous material web, especially a paper or cardboard web, with a double-screen segment, in which two sieves are guided approximately parallel to one another and into which a fibrous material suspension is guided, a roll, around which the double-screen segment is looped; apparatus arranged on the roll for the immobilization of the fibrous material suspension in the doublescreen segment for the formation of the fibrous material web, and apparatus to further drain the fibrous material web.

2. Discussion of Background Information

Furthermore, the invention relates to a method for the manufacture of a fibrous material web, especially a paper or cardboard web with the steps to guide two screens in a double-screen segment approximately parallel to one another and around a roll, to introduce a fibrous material suspension into the double-screen segment, to immobilize the fibrous material suspension on the roll in the double-screen segment while forming the fibrous material web, and to drain the fibrous material web further.

Such a wet section and a method of this kind for the manufacture of a fibrous material web are generally known, e.g., from EP-A-0 607 549.

In the present context, a wet section is to be understood as the section located before the drying section of a paper or cardboard machine, that is normally the arrangement of head box, screen section, and press section. It is given that especially the screen section and the press section do not necessarily have to lie in sequence behind each other. So, for example, pressing elements can be contained in the actual screen section.

The wet section bears particular significance in the manufacture of paper webs. In the wet section, the immobilization of the fibrous material suspension, which has been supplied in fluid form, takes place. The fibers which initially float freely in the suspension thereby are "immobilized" relative to one another via the removal of water. Prior to or during the immobilization, irregularities which appear can be compensated only insufficiently or not at all through subsequent sections of the paper machine.

The construction of such a wet section is typically a compromise between different, competing demands, including web run speed, web width, regularity of the characteristics of the finished paper web, surface quality, as well as compactness of the machine, the lowest possible inclination toward contamination, easy access for cleaning, as little expense as possible, etc.

Double-screen segments are used in wet sections in so-called gap-formers as well as in so-called hybrid-formers. Two continuous screens are guided thereby over a segment, the double-screen segment, parallel to each other.

In gap-formers, the two screens are guided over a forming roll as a support body, with the fibrous material suspension being introduced from a head box into an opening formed by the two screens and lying near to the forming roll.

In known wet sections, the two screens are guided over another segment parallel to one another following the looping around the forming roll; typically, forming strips and/or draining media such as suction boxes are arranged in this other segment in order to assist the draining of the fibrous material suspension, i.e., the "immobilization," or the further draining of the fibrous material web in this other segment; see for example EP-B-0 489 094.

The noted forming strips preferably are pressed flexibly onto one of the two screens, each with a force which can be selected. It is thereby possible to optimize the so-called formation (transparency) in the finished paper.

The screen section known from EP-B-0 489 094 has a very big length, however, and exhibits a large number of individual parts.

Furthermore, a wet section in the prior art is disclosed in the German patent application 196 34 995.8.

In this wet section, similar to that in EP-A-0 607 549, an upper screen and a lower screen are looped around a forming roll and hereafter guided parallel to each other to a screen-suctioning roll, which serves further draining of the formed fibrous material web after the immobilization. In the vicinity of the suctioning zone of the screen-suctioning roll, the upper screen is lifted from the web, so that the fibrous material web remains on the lower screen.

In EP-A-0 607 549, mentioned at the outset, the two screens are guided parallel from the forming roll to a screen-suctioning roll which serves the further draining of the web. In the vicinity of its suctioning zone, the outer screen is lifted from the web and the inner screen so that the web remains behind the double-screen segment on the inner screen.

SUMMARY OF THE INVENTION

The problem which forms the basis of the invention consists thus of indicating a wet section which is compact, inexpensive to manufacture, and can be maintained cost-effectively.

This problem is solved with the wet section noted at the outset in that the roll is a combined forming and draining roll, which exhibits a forming sector, on which the immobilization media are arranged, as well as a draining sector located in the direction of the running screen behind the forming sector; at least a predominant portion of the draining media are arranged on the draining sector.

The problem is also solved with the process noted at the outset for the manufacture of a fibrous material web, moreover, in that the immobilization occurs in a forming sector of the roll and at least a predominant part of the subsequent draining occurs in a draining sector of the roll located in the direction of the running screen behind the forming sector.

The problem is completely solved in this way.

With the invention, a so-called "mono-suctioning roll" former is realized. Departing from the previous basic concept of wet sections, in which only the immobilization or a part of the immobilization process occurs on a forming roll, in accordance with the invention not only the immobilization of the fibrous material suspension is attained on the combined forming and draining roll, but also a substantial, additional draining of the likewise formed fibrous material web. Thus, the fibrous material web, running from the combined forming and draining roll (below, combination roll), can, if necessary, be transported directly into a press section or even directly into a drying section. Hereby, a multiplicity of individual elements, especially an additional screen-suctioning roll, is spared. The wet section in accordance with the invention can hereby be manufactured more cost-effectively arid is extremely compact. Fewer replacement parts must be provided during operation, so that even the maintenance of the wet section is especially cost-effective. Because for the maintenance of wet sections, a reserve roll must be kept available for every type, in order to minimize machine down times. With the wet section in accordance with the invention, only the combination roll thus must be provided in duplicate, and not respectively a combination roll and an additional screen-suctioning roll. The single combination roll enables large web widths and high belt running speeds.

Preferably, the outer screen facing away from the roll is guided so that it is lifted in the vicinity of the draining sector away from the fibrous material web.

The fibrous material web, formed and drained further, remains on the screen facing the combination roll. Following this it can be conveyed directly or after a suitable diversion into another section of the paper machine.

Since the combination roll in the draining sector always exhibits suctioning segments for draining, one of the same can be used as a separating suctioning segment (as with known, conventional suctioning rolls).

With a preferred embodiment, the fibrous material web exhibits a dry content of at least 10%, and preferably at least 12%, in the area of its runoff from the combination roll.

In conventional forming rolls, the dry content of the fibrous material suspension or web in the runoff area always lies 4–7%. By providing a draining sector on the combination roll in accordance with the invention, the dry content of the fibrous material web can be increased significantly in the area of the runoff from the combination roll, a predominant portion of the subsequent draining of the fibrous material web occurring after the immobilization on the draining sector. Hereby it is possible to transport the fibrous material web directly into a press section or even into a drying section of the paper machine. In any case, only a few more draining elements are necessary from the discharge area of the combination roll to another section of the paper machine.

Preferably, the outer screen facing away from the combination roll is lifted by means of a screen guiding roll from the fibrous material web, whereby the screen guiding roll is designed to be adjustable, in order to adjust the length of the double-screen segment.

Hereby it is possible to change the length of the double-screen segment and in particular, that of the draining sector, in order to adapt the wet section to various paper grades and to various types of paper stock supplied. In a stock which can be drained easily, one will lift the outer screen facing away from the combination roll early on, in order to keep the remoistening of the formed fibrous material web from the outer screen low. By contrast, with material which is difficult to drain it will be necessary to keep the outer screen on the fibrous material web and the inner screen facing the combination roll for a relatively long time. Otherwise, the outer screen can carry a certain portion of the fibrous material web with it.

It is furthermore preferred if the fibrous material suspension is introduced into the double-screen segment by means of a head box and if the head box is arranged so that the fibrous material suspension flows out against the force of gravity.

On the one hand, the head box idling at the transitory down time of the wet section is avoided hereby. Thus, distortion of the head box is avoided above all through the lack of the typically heated fibrous material suspension. A distortion results in a loss in valuable time until the head box assumes the correct form during a restart.

In an advantageous development of the invention, the combination roll exhibits at least one draining suctioning section in the draining sector for the draining the fibrous material web.

Via such a draining suctioning section, it is guaranteed that a draining—against centrifugal force—can ensue through the screen facing the combination roll.

It is thereby especially preferred if the combination roll exhibits a multiplicity of draining suctioning segments.

A multiplicity of draining suctioning segments allows a large variability with respect to the suctioning capacity. In other words, the suctioning capacity can be adjusted variously in a simple, constructive manner via the draining sector with this embodiment of the invention.

It is preferred, furthermore, if the suctioning capacity of the draining suctioning sections in the direction of the running screen is larger from section to section.

Via this measure, the suctioning capacity is adapted optimally to the suction requirement, since the water content of the fibrous material suspension decreases over the length of the draining sector, so that the draining resistance becomes greater. In other words, the higher the web dry content becomes, the higher the air speed must be in order to still be able to remove water from the web by means of vacuum pressure.

At the same time, it is especially preferred if a vacuum pressure of 0.6 to 0.99 bar absolute is applied to a first draining suctioning section, a vacuum pressure of 0.3 to 0.7 bar absolute to a second draining suctioning section, and a vacuum pressure of 0.2 to 0.4 bar absolute to a third draining suctioning section.

It is preferred, moreover, if the draining suctioning sections extend over a sector of the combination roll from 60° to 150°, especially 70° to 90°.

Hereby one attains a sufficient length of the draining sector in connection with a corresponding diameter of the combination roll, in order to drain the fibrous material web at the combination roll enough so that the formed fibrous material web can essentially be transferred without additional draining means to a subsequent press section or drying section.

It is especially preferred if the roll in the forming sector exhibits at least one forming suctioning section.

Via this measure, a draining of the fibrous material suspension is attained not through the outer screen facing away from the combination roll alone, but also through the inner screen. The "forming capacity" or "forming speed" can be increased hereby. In other words, the immobilization of the fibrous material suspension can be attained in a short period of time or via a comparatively short forming sector.

At the same time, it is preferred if a vacuum pressure of 0.7–0.99 bar absolute is applied to a first forming suctioning section.

Such a value enables a sufficiently strong draining of the still largely fluid fibrous material suspension on the one hand. On the other hand, this value is not so high that the quality of the finished fibrous material web is negatively affected.

Preferably, the forming segment(s) extend(s) over a sector of the roll from 20° to 100°.

It has been observed that a complete immobilization of the fibrous material suspension can be attained within such a sector, especially when the diameter of the combination roll is large.

In accordance with a particularly preferred example, the jacket of the combination roll is designed as a reservoir for the water taken from the fibrous material suspension or web.

Via this measure, it is possible, on one hand, to drain the fibrous material suspension or web to match demand. On the other hand, it is not necessary to remove a larger volume flow of water continuously via the inside of the combination roll. If the combination roll is suctioned over the entire looping area of the two screens, at least a considerable portion of the water remains until behind the last suctioning section in the combination roll jacket. Afterwards, the water is spun out of the jacket due to centrifugal force. Thus, the kinetic energy of the combination roll is utilized in an advantageous manner, in order to again divert the water extracted from the fibrous material suspension or web. The performance requirement of the wet section in accordance with the invention can be decreased hereby. It is self-evident thereby that in the spin-off area behind the last suctioning section, an accordingly dimensioned collection box preferably is provided, in order to collect the water spun off.

It is especially preferred if the combination roll is fitted with a suctioning unit which produces an air flow volume that is sufficient to suction essentially all the water extracted through the inner screen from the fibrous material suspension or web into the jacket of the combination roll.

Hereby, it is attained in a structurally simple manner that the draining of the fibrous material suspension or web can ensue both through the outer screen, due to centrifugal forces, as well as through the inner screen. Insofar as the outer screen is already lifted from the fibrous material web in the area of the draining sectors, a further draining ensues alone via the inner screen.

It is especially preferred if the suctioning unit diverts the air flow volume to both front ends of the combination roll.

It is attained hereby that the velocity of the flow of air volume—with a given suctioning cross-section—is reduced significantly. Each front end thus "services" about half the machine width of the combination roll, for example.

It is preferred, furthermore, if the combination roll does not exhibit its own drive.

Hereby, a suctioning-off to both front ends of the combination roll can be realized in a particularly simple structural manner.

In accordance with another preferred embodiment, at least one forming strip, which can be flexibly pressed to the outer screen facing away from the roll, is arranged in the forming sector.

Hereby, the "formation" of the finished paper web can be significantly improved; i.e., the fibers are distributed in the web more uniformly.

At the same time, it is particularly preferred if the forming strip(s) on the outer screen is (are) arranged opposite the forming suctioning section(s) of the combination roll.

Via the combination of a forming suctioning segment on the combination roll and a forming strip opposite the forming suctioning segment, the immobilization of the fibrous material suspension can ensue particularly quickly and effectively. Through the forming strip, which can be applied in a flexible manner, pressure impulses can be introduced into the fibrous material suspension, whereby fibrous clumps which may potentially form are dissolved. This leads, on the one hand, to an easier water removal and, on the other hand, to a more even distribution of the fibrous materials in the finished fibrous material wet).

It is particularly preferred if a row of 3 to 15 forming strips, and preferably 5 to 8, is arranged over the forming sector.

It is preferred, furthermore, if on the outer screen facing away from the combination roll, the water collection box is arranged extending itself approximately over the entire double-screen segment.

It is possible, hereby, to collect the water escaping through the outer screen.

It is preferred, furthermore, if another water collection box is arranged on a peripheral segment of the combination roll, which is located behind a last suction segment.

In this other water collection box, the water stored in the jacket of the combination roll can be extracted and collected.

Via the water collection boxes, a contamination by water of the remaining parts of the wet section or by "fog" appearing by atomization effects is largely hindered or completely eliminated. Overall, the invention enables a construction style in the so-called "clean design."

At the same time, preferably, at least one water collection box is arranged such that water is collected essentially due to the force of gravity alone.

It is possible hereby to collect and divert the water spun out, without having to provide a vacuum chamber. This brings with it considerable savings in energy. It is particularly preferred if one water collection box, assigned to the double-screen segment, as well as another water collection box, arranged behind the last suctioning section, are arranged in this manner, for example, on opposite horizontal sides of the combination roll.

It is of particular advantage, if the diameter of the combination roll is greater than 1.5 m, and in particular, greater than 2 m.

Such a diameter enables the formation of sufficiently long forming and draining sectors with relatively small angles of belt contact of the two screens around the combination roll. In addition, the centrifugal force acting upon the water (streaming inside through the roll jacket) is relatively small; the specific draining capacity (according to surface unit) is consequently relatively large. In other words, it can be guaranteed that the fibrous material web is drained sufficiently enough at the end of the draining sector, in order to be transferred to a subsequent section of the paper machine.

Furthermore, surprisingly, it has been shown that the disadvantage of a more elaborate construction of a combination roll with an accordingly larger diameter is compensated much more by the advantages that can be attained.

In accordance with another preferred embodiment, at least one extended-nip press device is arranged on the outer belt facing away from the combination roll in the draining sector.

Via the measure of providing a pressing device already on the combination roll, the fibrous material web running off the combination roll can have a much higher dry content. The combination roll is thus constructed as a combined forming, draining, and press roll. The attainable dry content of the fibrous material web which can be targeted can be sufficient to transfer the fibrous material web directly onto a conventional drying section.

In accordance with a preferred embodiment, the extended-nip press device exhibits a shoe press roll, whose mating roll is the combination roll.

In contrast to traditional extended-nip press devices, a roll is hereby spared. Moreover, it results in a high savings potential in guide rolls, suctioning rolls, etc., for otherwise typical transfer belts from the screen section into the classic pressing section. A shoe press roll is particularly suited because on one hand, the pressure exerted is adjustable and on the other, the friction losses are low, since the jacket of the shoe press roll runs corresponding to the belt velocity.

At the same time, it is particularly preferred if the outer screen is looped around the shoe press roll, so that it is lifted from the fibrous material web.

The shoe press roll thus simultaneously acts as a guiding roll for the outer screen. Because of the draining suctioning section lying opposite, the fibrous material web remains securely on the inner screen.

In accordance with an alternatively preferred embodiment, the shoe press roll is arranged behind the double-screen zone on the combination roll.

It is an advantage that the guiding roll for the outer screen facing away from the combination roll can be designed so as to be displaceable; that is, the length of the doublescreen segment can be adjustable. Moreover, it is possible to eliminate a separate press felt inside the loop of the outer screen. Thereby a construction can be attained which is easy to manage and uncomplicated.

At the same time, it is particularly preferred if a belt is looped around the shoe press roll, by means of which the fibrous material web is taken from the inner screen facing the roll.

Though this measure, it becomes possible to eliminate a separate take-up roll for the removal of the fibrous material web from the inner screen. Overall, a wet section results which is particularly compact and cost-effective to make.

In an alternative embodiment, it is preferred if a belt is looped around the shoe press roll, the band being removed just behind the shoe press roll from the fibrous material web, whereby the fibrous material web is removed behind the shoe press roll from the screen facing the roll.

In this alternative embodiment, the remoistening of the fibrous material web behind the shoe press roll the belt looped around the shoe press roll can be avoided. This is because the moistened belt (typically a felt) is removed just behind the shoe press roll by means of a separate take-up roll, typically. The fibrous material web is thus removed from the combination roll by an additional—dry—take-up belt, which is looped around the separate take-up roll.

It is particularly preferred if no other press devices are provided between the runoff point of the fibrous material web from the combination roll and a transfer point of a drying section.

It is possible hereby to make an especially compact wet section available, which assumes both the function of a traditional screen section as well as the function of a conventional pressing section.

It is particularly preferred that the wet section in accordance with the invention is used for the manufacture of graphics paper with a surface weight of 30 to 110 g/m$^2$.

It is to be noted generally that felts or a felt/screen combination can also be used in place of screens. The head box can be consistency-controlled, in order to be able to influence the cross directional profile.

It is self-evident that the features noted above and those below yet to be explained can be used not only in the combination respectively given, but also in other combinations or in isolation, without leaving the scope of the present invention.

Embodiment examples of the invention are depicted in the figures of the drawings and are explained in more detail in the following specification.

DETAILED DESCRIPTION OF THE PRESENT INVENTION

Figure 1:
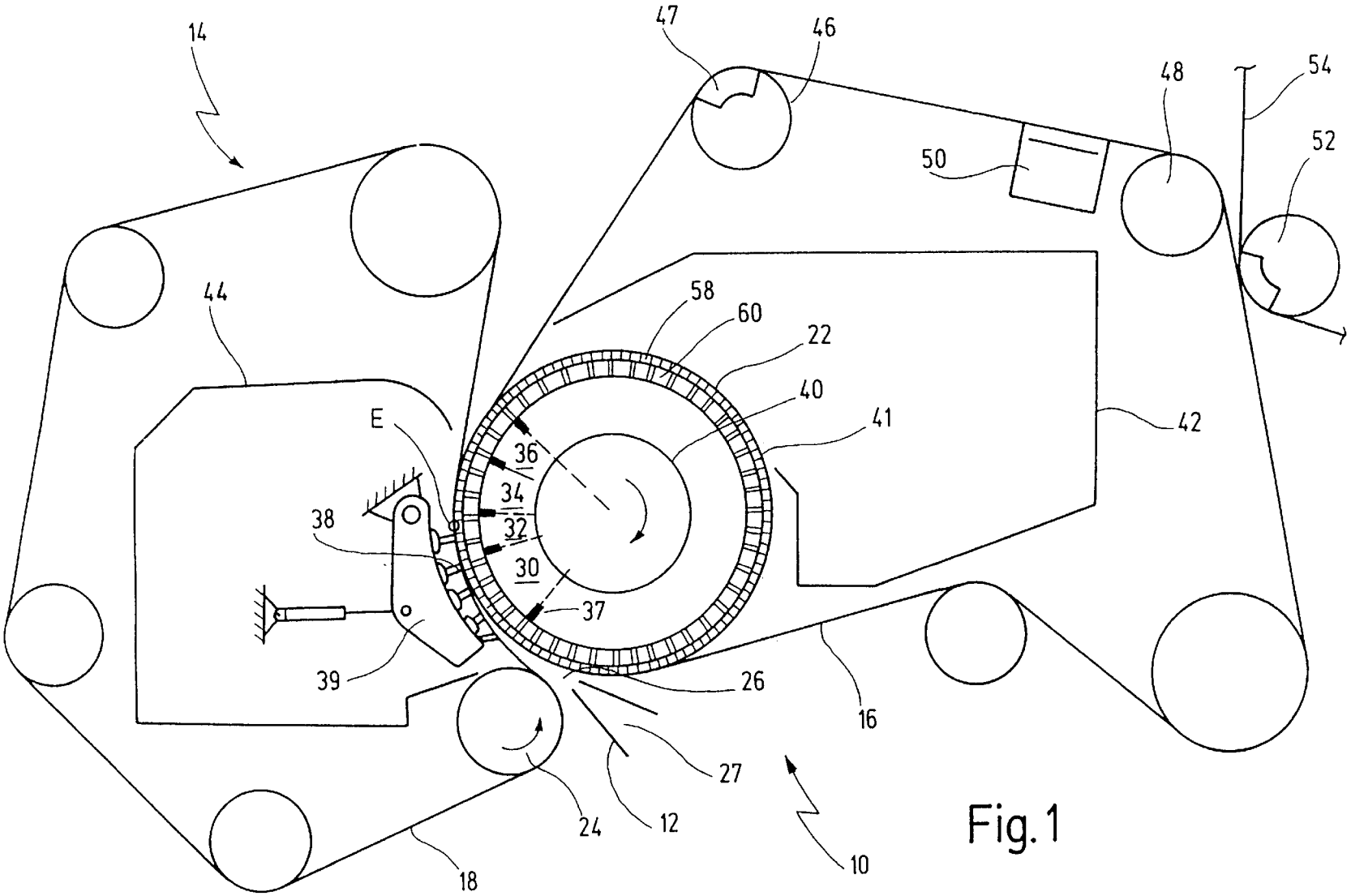
FIG. 1 shows a schematic side-view of an embodiment of a wet section in accordance with the invention.

The first embodiment of the wet section in accordance with the invention is generally noted in FIG. 1.

The wet section 10 exhibits a head box 12 and a screen section 14.

Figure 2:
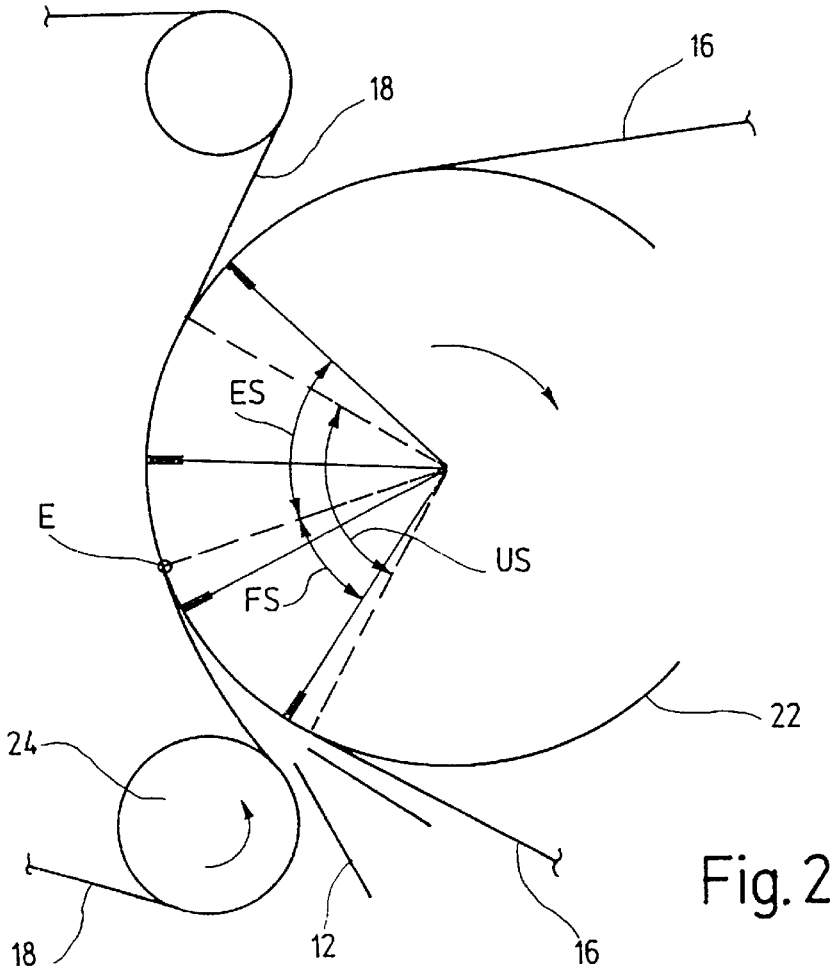
FIG. 2 shows a schematic depiction of the combination roll to explain the nomenclature used.

The screen section 14 exhibits a continuous inner screen 16 and a continuous outer screen 18, which are guided approximately parallel to each other in a double-screen segment US (see FIG. 2).

Furthermore, the screen section 14 exhibits a combined forming and draining roll (in the following, combination roll) 22 in the inner screen 16 and a breast roll 24 lying opposite in the outer screen 18. The combination roll 22 and the breast roll 24 are arranged such that an opening 26 is formed, into which a fibrous material suspension 27 is introduced from the head box 12 diagonally from below, so that the fibrous material suspension 27 flows out against the force of gravity.

The combination roll 22 exhibits four consecutive suctioning sections 30, 32, 34, 36. The first suctioning section 30 starts about at the winding-on point of the outer screen 18 onto the combination roll 22. The third suctioning segment 34 ends about in the area of the runoff of the outer screen 18 from the combination roll 22. The fourth suctioning section 36 extends to the area of the runoff of the inner screen 16 of the combination roll 22.

The four suctioning sections 30, 32, 34, 36 lie in a row locally fixed in the machine direction of the screens 16, 18 directly. The four suctioning sections 30, 32, 34, 36 extend over a sector FS+ES, as defined in the nomenclature from FIG. 2; that is, they expand across a so-called forming sector and a so-called draining sector.

The forming sector FS is that sector in which the immobilization of the fibrous material suspension takes place. The forming sector FS ends on a line; this appears in the illustration as point E, in which the immobilization of the fibrous material suspension is closed. At the point E, the draining sector ES begins, in which the fibrous material web, formed by the immobilization, is further drained. The sectors FS and ES preferably lie directly behind one another, with the line of separation being formed by point E. They can, however, also be spaced apart in such a manner that between the forming sector FS and the draining sector ES no draining takes place. One can imagine that the screens converge toward each other up to point E, which is drawn in exaggeration in the illustration.

Moreover, it is to be perceived from FIG. 2 that the entire sector, which is formed by the forming sector FS and the draining sector ES, does not necessarily coincide with the double-screen segment or double-screen sector US. Also, the forming sector FS and the draining sector ES do not necessarily coincide with certain suctioning sections. The point E is located in FIG. 1 in the suctioning section 32.

The double-screen segment US extends, as noted at the outset, over that sector in which the two screens are guided approximately parallel to one another. In any case, the outer screen is lifted from the combination roll 22 after the point E, and in fact, by means; of a screen guide roll. Depending upon the application, the outer screen can be lifted from the combination roll 22, just after point E, in the vicinity of the end of the last suctioning section or between. To this end, the guiding roll is preferably constructed to be adjustable (not depicted in more detail).

The inner screen 16 loops around the combination roll 22, preferably up to the end of the last suctioning section 36, as it is shown in FIG. 1.

The suctioning sections 30 through 36 are separated from each other by packing strips 37, in order to construct an adjustable, different vacuum pressure at each of the suctioning sections.

On the outer screen 18, a multiplicity of forming strips 38 is located in the forming sector FS (four in the illustration, as an example), which are arranged in the direction of the running screen behind one another. The forming strips 38 are constructed as elastically flexible strips. A large portion of the strips (in the present case, three) is arranged opposite the first suctioning section 30. The remaining forming strips 38 (presently, one) are arranged opposite the second suctioning section 32. A stiff, water-reversal strip which does not touch the outer screen can be arranged in front of the first forming strip in the direction of the running screen, as is shown schematically in FIG. 1. The last forming strip 38 is arranged before point E, in any case. As is shown in FIG. 1, the forming strips can be mounted together with the reversal strip to a yoke 39 which is linked to a stationary hinge and which can be pressed against the combination roll 22.

The suctioning sections 30, 32, 34, and 36 are connected to a schematically depicted suctioning unit 40.

The suctioning unit 40 exhibits a bearing pipe which is concentric to the jacket of the combination roll 22 and which is connected on both front ends of the combination roll 22—that is, both on the lead side as well as on the drive side—to a corresponding blower (not depicted) in order to be able to produce the necessary vacuum at the suctioning sections 30, 32, 34, 38. The suctioning unit 40 is explained below with greater precision using FIG. 7.

The jacket 41 of the combination roll 22 is designed as a perforated roll jacket 60 and covered with a honeycomb covering 58. The water suctioned up via the suctioning sections 30 through 36 is stored in the honeycomb covering 58 and in the holes of the roll jacket 60.

A water collection chamber 42 is arranged in the area of a peripheral section of the combination roll 22 following the last suctioning section 36. The water stored in the jacket 41 of the combination roll is spun from the jacket 41 in the vicinity of this peripheral section, due to the appearing centrifugal forces, and collected in the collection box 42, and diverted, if necessary.

Across from the three draining suctioning sections 30, 32, 34, another collection box 44 is arranged on the outer screen 18, in order to intercept, to collect, and, if necessary, to divert water escaping from the outer screen 18.

A guiding roll 46 is arranged in the direction of the running screen behind the combination roll 22. The inner screen 16 is wrapped around the guiding roll 46. At the same time, the guiding roll 46 can be suctioned, as is shown schematically with 47.

Behind the guiding roll 46, another guiding roll 48 is arranged; between the two guiding rolls 46, 48, a flat suction box 50 can be arranged.

On a suctioned take-up roll 52, the fibrous material web is taken from the inner screen 16 onto a belt 54 and transferred into another section of the paper machine.

In FIG. 1, other guiding rolls are shown but not in more detail. These guiding rolls serve the completion of the screen circuits and can be adjusted according to demand. It is given that all elements of the wet section 10 are constructed according to the width of the machine, if not otherwise noted.

During operation, the relatively thin fluid fibrous material suspension 27 is introduced by means of the head box 12 into the opening 26. In order to suction water through the inner screen 16 into the jacket 41 of the combination roll, a relatively low vacuum suffices in the first suctioning section 30.

In the following suctioning sections 32 and 34, a larger suctioning capacity is needed, on the one hand to still remove water from the fibrous material suspension or web and, on the other hand, to keep the already-removed water in the jacket 41 of the combination roll 22.

In the area of the first and the second suctioning sections 30, 32, the initial draining for the immobilization of the fibrous material suspension 56 occurs up to point E. Through the forming strip 38, which is arranged on the outer screen 18, it is guaranteed that a good "formation," i.e., an even distribution of fibers, and a uniform cross directional profile of the fibrous material web are attained. In the vicinity of the other suctioning sections, 34, 36, another draining of the formed fibrous material web occurs.

At the end of the third suctioning section 34, the outer screen 18 separates itself from the formed fibrous material web. The fibrous material web remains secure on the inner screen 16, due to the suctioning sections 34, 36. The inner screen 16 is transferred to the guiding roll 46 from the combination roll 22 at the end of the fourth suctioning section 38.

The water stored in the jacket 41 of the combination roll 22 is spun out behind the fourth suctioning section 36 radially due to the centrifugal forces and collected by the box 42.

It is given that both the suctioning section 47 of the guiding roll 46 as well as the flat suction box 50 are not necessary as defined by the invention. They can, however, be provided according to demand and in certain applications.

Overall, the suctioning unit 40 produces a very high air flow volume. Because this air flow volume is diverted via the bearing pipe of relatively large diameter and to both front ends of the combination roll 22, the velocity of the air flow volume can be kept low.

It is given that cleaning devices can be assigned to the screens 16, 18. Furthermore, constructing the wet section 10 in the so-called "clean design" is preferred, whereby closed and suctioned screen chambers are present in the vicinity of the draining zones.

It is especially preferred that the wet section 10 is used for the manufacture of graphics paper about with 30 to 110 $g/m^2$.

Figure 3:
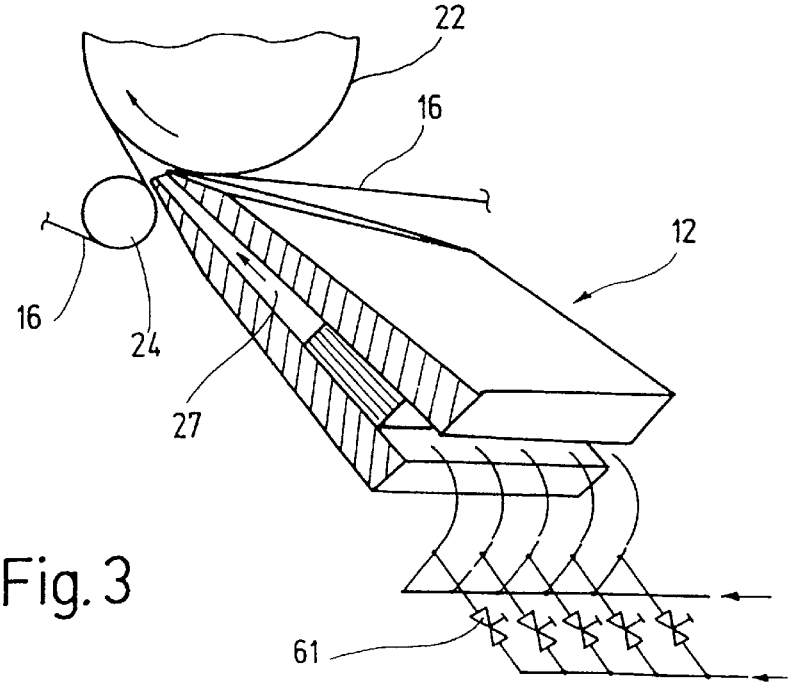
FIG. 3 schematically shows a head box which is consistency-controlled to influence the cross directional profile.

In FIG. 3, shown in schematic form is a head box 12 which is consistency-controlled and which is suited for the control of the cross directional profile with different characteristics of the fibrous material web, especially of the cross directional profile basis weight and fiber-orientation. The fibrous material suspension 27 is supplied in dilutions which can be regulated sectionally by means of a large number of dilution-water control valves 61 which are arranged in distribution over the machine width. At the same time:, the mixer structure is arranged advantageously such that each of the sectional volume flows remains constant with a local change of the dilution; see patent DE 40 19 593.

Figure 4:
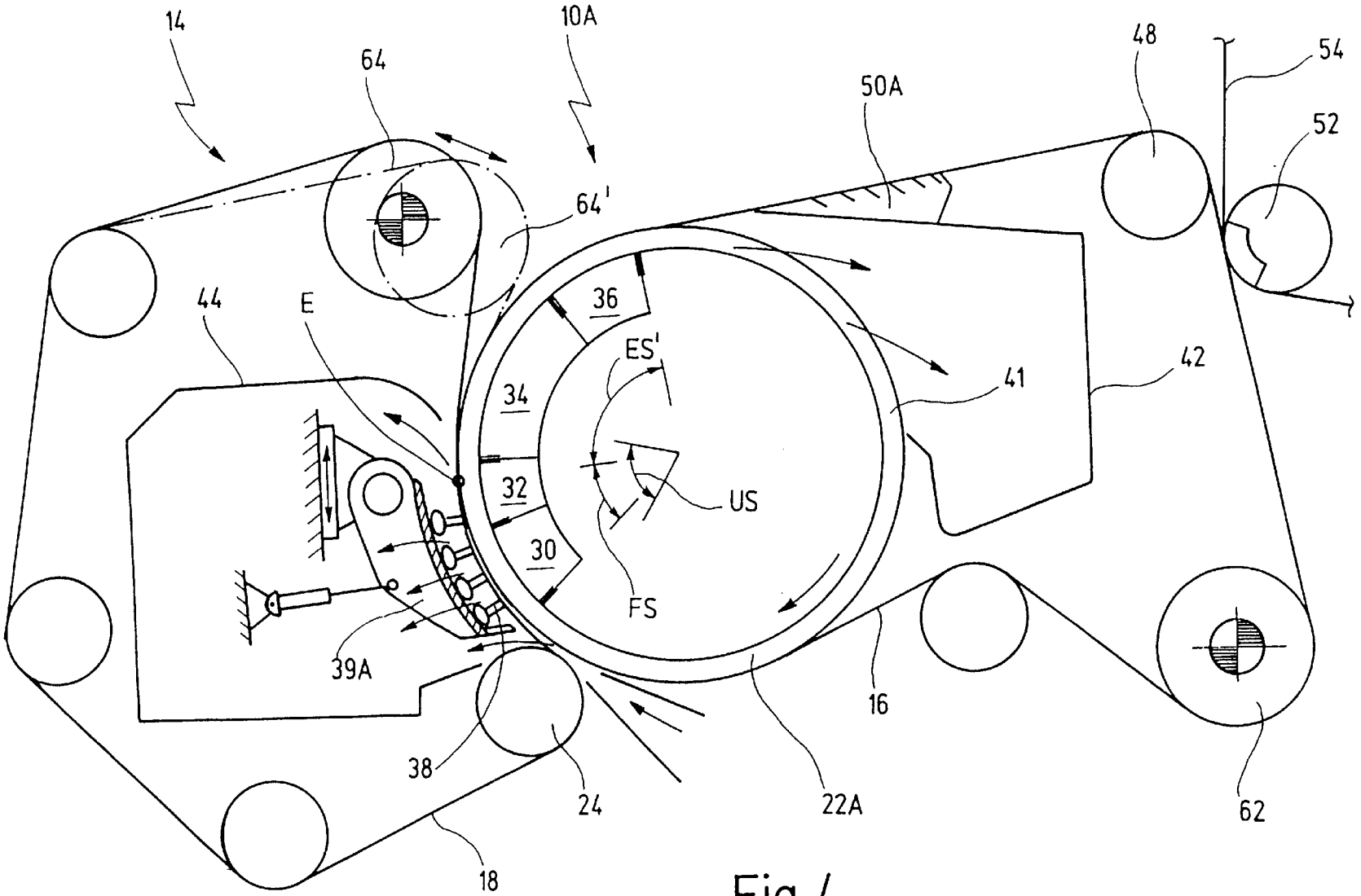
FIGS. 4 through 10 show schematic side-views of other embodiments of a wet section in accordance with the invention.
Figure 5:
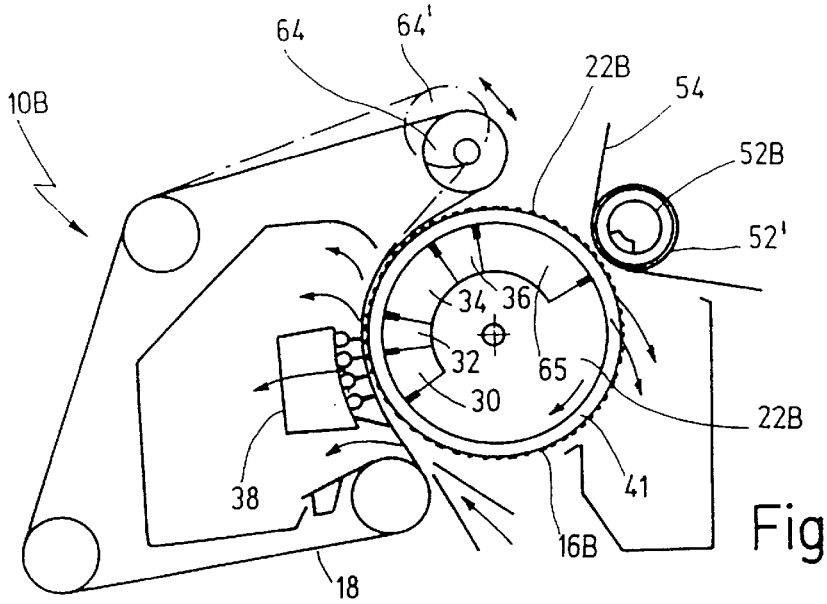
Figure 6:
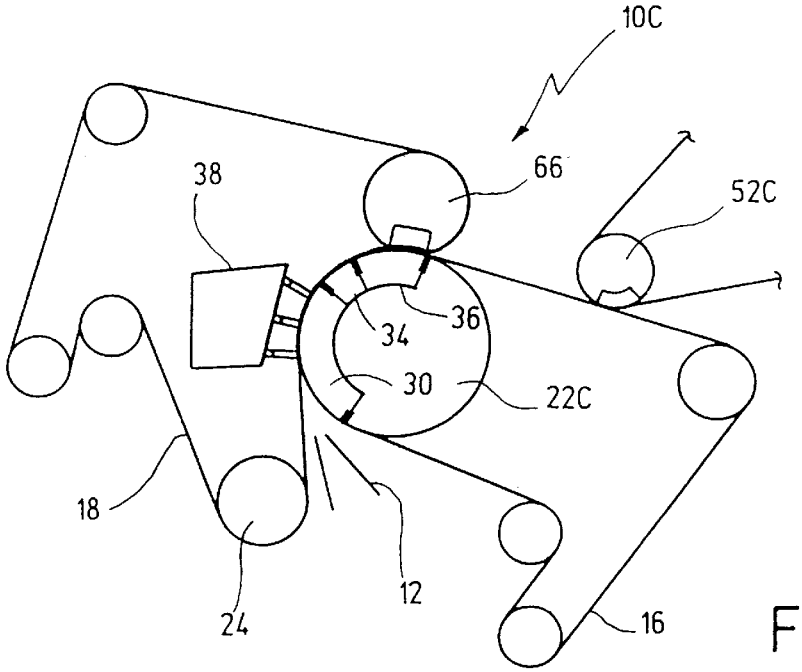
Figure 8:
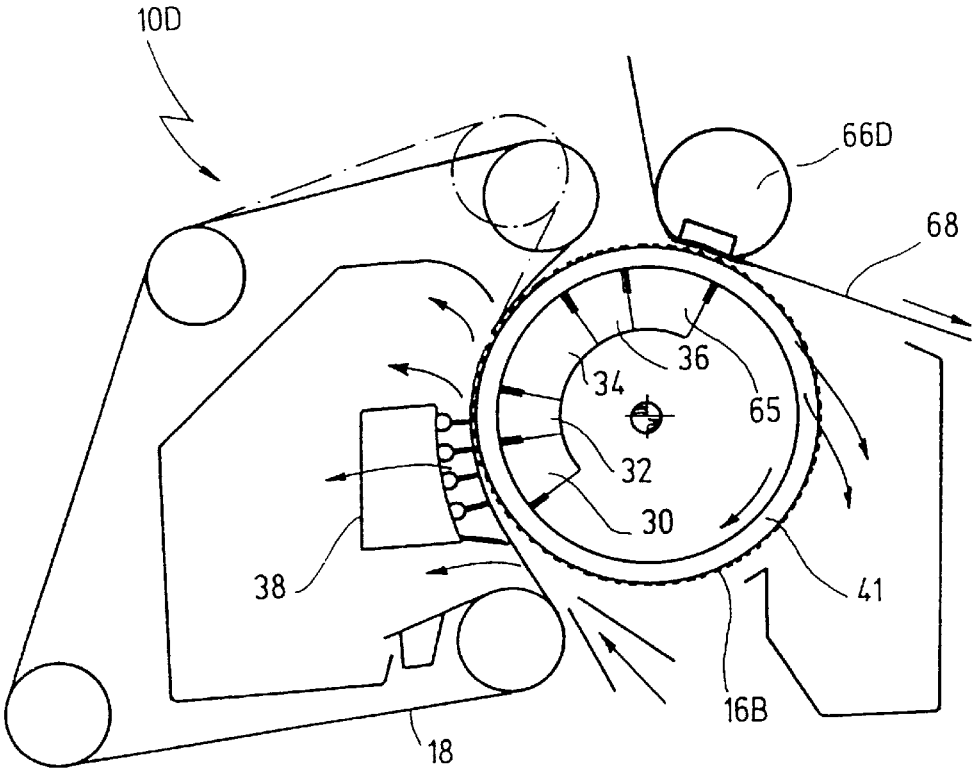
Figure 9:
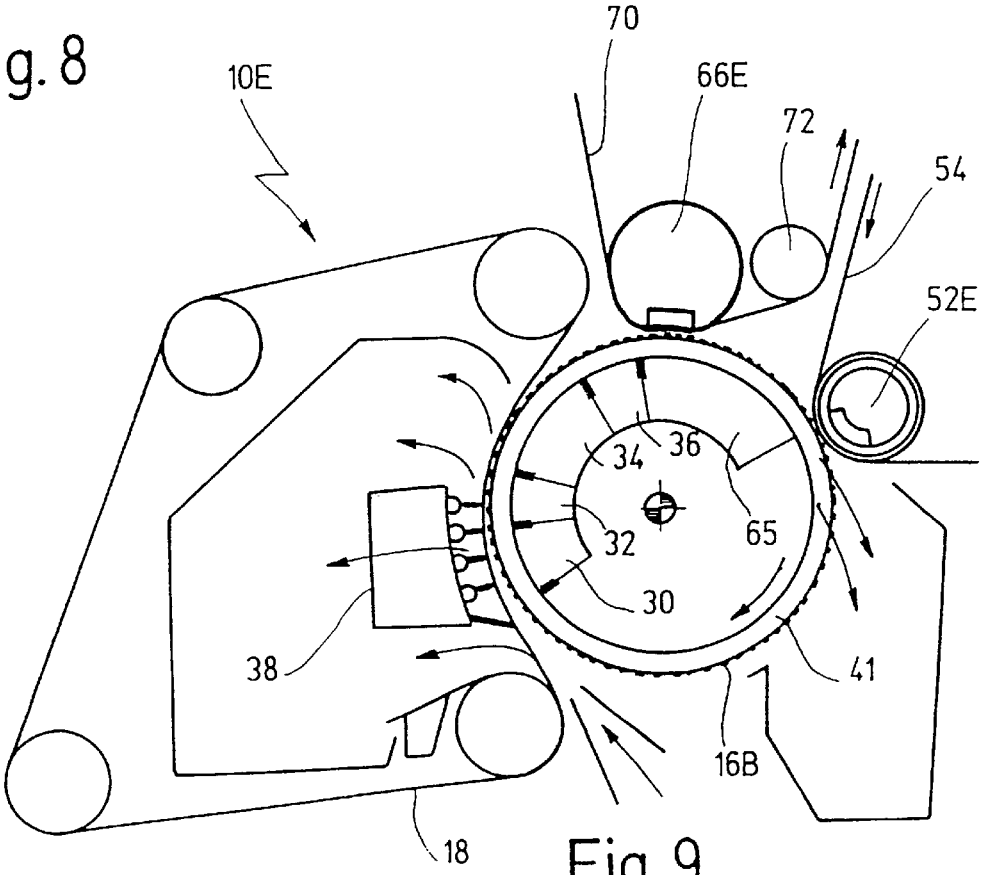
Figure 10:
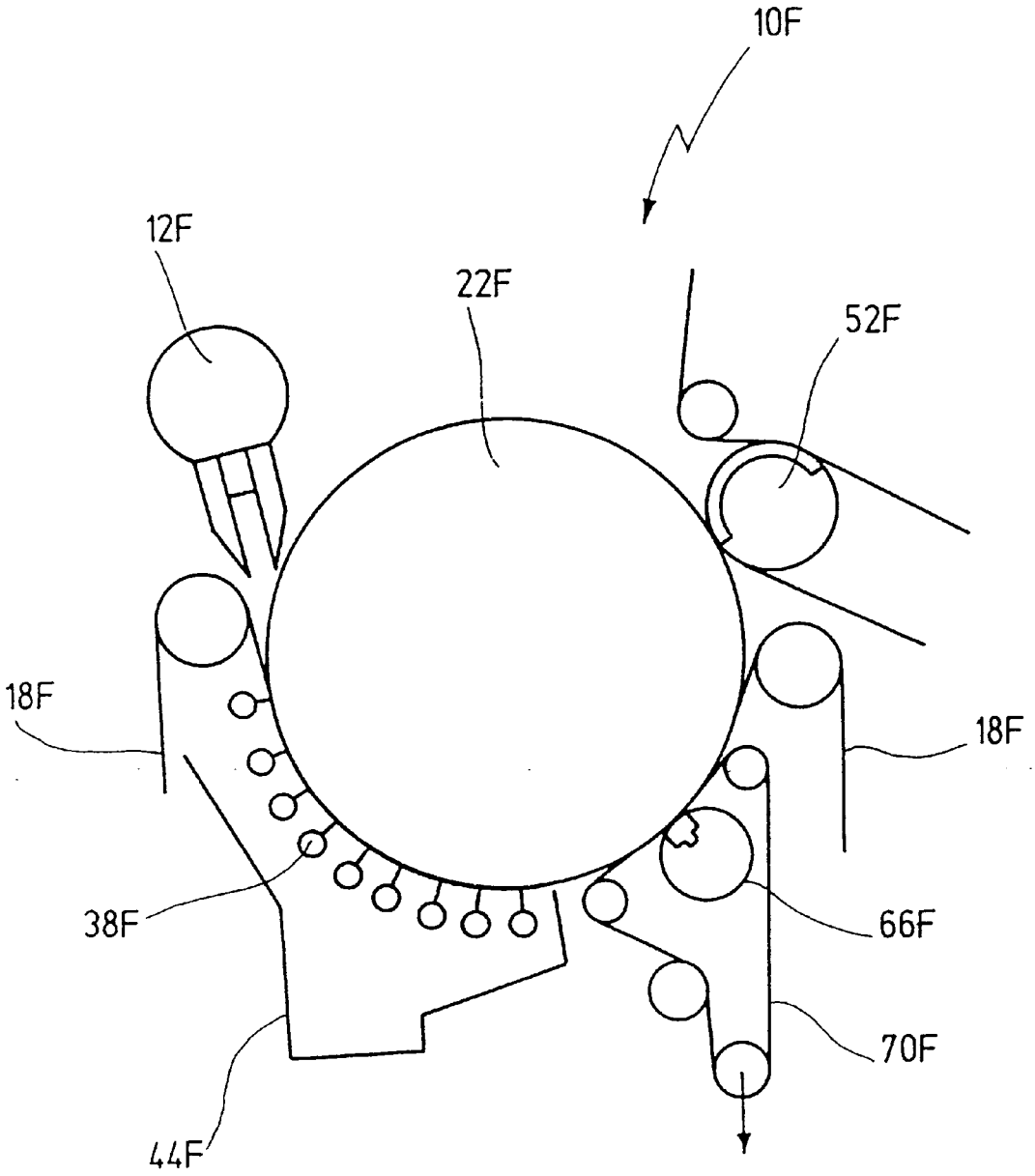

Further forms of the embodiment of a wet section in accordance with the invention are generally noted by 10A in FIG. 4, by 10B in FIG. 5, by 10C in FIG. 6, by 10D in FIG. 8, by 10E in FIG. 9, and by 10F in FIG. 10.

Elements with identical function such as corresponding elements of the wet section 10 from FIG. 1 are fitted with identical referential numbers. Thereafter, therefore, only the differences from the wet section 10 will be discussed.

The combination roll 22A of the wet section 10A exhibits a diameter which is comparatively even greater than the combination roll 22 of FIG. 1 Moreover, the combination roll 22A is not driven. The drive of the inner screen 16 ensues via one of the guiding rolls in the inner screen 16, in the present case a guiding roll 62.

In contrast to the wet section 10 of FIG. 1, the outer screen 18 is lifted from the fibrous material web almost directly behind the point E, so that the sector angle of the double-screen segment US is not significantly greater than the angle of the forming sector FS.

Furthermore, between the combination roll 22A and the take-up roll 52, no other suctioned roll is provided. The inner screen 16 is guided between the combination roll 22A and the take-up roll 52 only via the diversion roll 48.

A suctioning box 50A is provided between the combination roll 22A and the diversion roll 48. The suctioning box 50A is provided in an integral manner with the collection box 42, in such a manner that an outer wall of the suctioning box 50A simultaneously forms a wall of the collection box 42 at the same time. This is especially advantageous, since in this way, water clinging to the screen 16 or on the underside of the fibrous material web dripping on the machine parts located underneath is avoided.

In FIG. 4, moreover, it is shown in 64' that a roll 64 is driven and adjustable, by means of which the outer screen 18 is lifted from the fibrous material web, in order to be able to influence the length of the double-screen segment US.

The forming strip yoke 39A is designed to be adjustable in height, in contrast to the forming strip yoke 39 of FIG. 1, which is shown schematically by an arrow, in order to be able to undertake changes in various consistencies of the fibrous material suspension in a simple manner. The roll 64 is designed to also be adjustable, in order to be able to guarantee that the outer screen 18 is lifted from the fibrous material web only after the point E, even with fibrous material suspensions which are difficult to drain. In addition, the possibility exists to execute the later draining in the draining sector ES at least partially with the covering of the web by the outer screen 18.

Another form of the embodiment of a wet section in accordance with the invention is noted generally by 10B in FIG. 5.

In contrast to the wet section 10 of FIG. 1, the inner screen 16B is fastened to the combination roll 22B as a fine-meshed "screen stocking," without running over other rolls.

Another suctioning section 65 is provided connected the suctioning section 36, the suctioning section 65 that serves to keep the water in the jacket 41 of the combination roll 22B. The suctioning section 65 extends from the suctioning section 36 to a point at which a suctioned take-up roll 52B transfers the fibrous material web onto a belt 54 from the jacket-like inner screen 16B. Following the suctioning section 65, the water found in the jacket 41 of the combination roll 22B is spun out into a collection box. In order to make the transfer of the web from the relatively stiff jacket of the combination roll 22B easier, the take-tip roll 52B has a soft covering 52'.

Another form of the embodiment of the wet section in accordance with the invention is generally referred to in FIG. 6 as 10C.

In contrast to the wet section 10 of FIG. 1, the outer screen 18 is guided around a shoe press roll 66, which forms an extended-nip press opening (press nip) together with the combination roll 22C in the vicinity of the last suctioning section 36. The shoe press roll 66 has a thin, flexible roll jacket and a press shoe with a concave running surface in a known manner. In FIG. 6, the roll 22C has the function of a combined forming, draining, and press roll. In this form of the embodiment, the formed fibrous material web can be transferred directly from the inner screen onto a belt of the drying section.

It is given that even in the wet section 10, collection boxes for water can be provided and that the jacket of the combination roll 22C can be constructed as a reservoir for the water taken from the fibrous material suspension.

Figure 7:
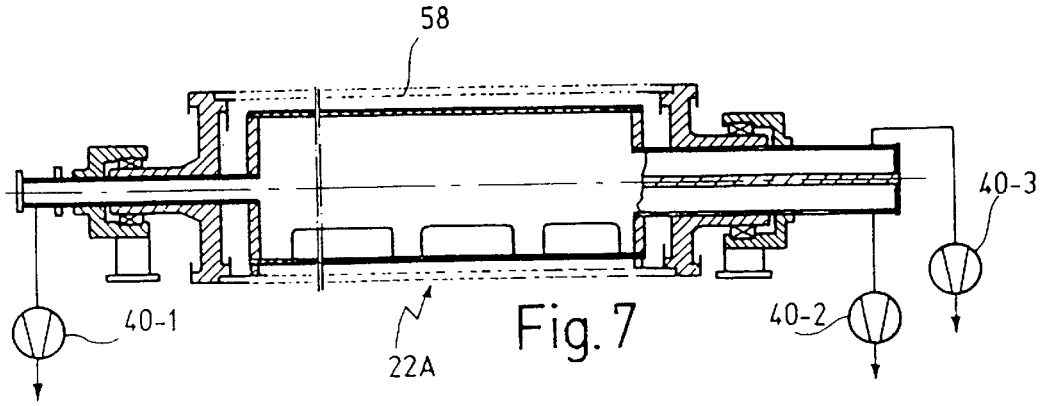

FIG. 7 shows a longitudinal section in largely schematic form, through the non-driven combination roll 22A of FIG. 4. At the same time, the cross-section runs through the suctioning section 30, for example, which is connected to the suctioning unit 40-1. The other suctioning sections 34, 36 are connected to the suctioning units 40-2 and 40-3, respectively.

It is to be recognized that the air flow volumes thus are diverted over both front ends of the combination roll 22A. In all cases, the entire suctioning cross-section is comparatively large. If needed, one can provide a bearing pipe with a larger suctioning cross-section at one front end (in FIG. 7, right) than at the other front end. This can make easier the arrangement of a drive for the combination roll 22A (at the left front end in FIG. 7), in the event that a drive is necessary.

In FIG. 8, another embodiment of the wet section in accordance with the invention is shown, which is generally referred to as 10D.

In contrast to the wet section 10B of FIG. 5, a shoe press roll 66D is provided in place of the take-up roll 52B. The shoe press roll 66D is arranged in a felt 68, by means of which the fibrous material web is removed from the inner screen 16B. This embodiment therefore possesses a comparatively simple construction. The felt 68 of the shoe press roll 66D serves at the same time as take-up felt for the continued conveyance of the fibrous material web.

Another embodiment of the wet section in accordance with the invention is generally referred to as 10E in FIG. 9.

In contrast to the wet section 10D of FIG. 8, a shoe press roll 66E is arranged in a separate felt 70, which is lifted quickly from the fibrous material web behind the shoe press roll 66E by means of a roll 72. The fibrous material web remains on the inner screen 16B, therefore, and is lifted by means of a take-up roll 52E from the inner screen, the construction of which corresponds to the take-up roll 52B of FIG. 5.

In this embodiment, in contrast to the wet section 10D of FIG. 8, the remoistening of the fibrous material web behind the shoe press roll 66E from the felt can be hindered. This is because the felt 70 is taken up directly from the fibrous material web behind the shoe press roll 66E.

Finally, another embodiment of the wet section in accordance with the invention is generally noted by the number 10F in FIG. 10. In contrast to the wet sections 10 through 10E shown previously, the head box 10F is arranged so that the fibrous material suspension flows from above to below. The fibrous material suspension flows into an opening which is formed by the combination roll 22F and an outer screen 18F. The combination roll 22F can, similar to the forming roll 22B, be covered with a fine-meshed "screen stocking" (not shown). The double-screen segment extends with the wet section 10F over almost 180°, with a row of forming strips 38F being again provided in a first part of the double-screen segment. The forming strips are located essentially in a lower section of the combination roll 22F, so that the water escaping via the outer screen 18F can be collected in a simple manner by a water collection box 44F.

In a second sector of the double-screen segment located subsequent to that, a shoe press roll 66F is provided, which is arranged in a circulating felt 70F. After the runoff of the outer screen 18F from the fibrous material web, the fibrous material web is removed from the combination roll 22F by means of a suctioned take-up roll 52F and transferred to another section of the paper machine.

It is self-evident that in an upper segment of the combination roll 22F, that is behind the take-up roll 52 F, a vacuum chamber must be provided, in order to safely absorb water which has been stored in the roll jacket of the combination roll 22F and spun upward.

In the wet sections 10, 10A, 10B, 10C, 10D, 10E, 10F, the screens 16, 18 can be replaced by felts or by a felt/screen combination.

The head box 12 can be a consistency-controlled head box in all cases, as is shown in FIG. 3, in order to be able to control the cross directional profile of the fibrous material web.

What is claimed is:

1. A wet section of a machine for the manufacture of a fibrous material web comprising:

a double-screen segment comprising two screens being guided approximately parallel to one another and into which a fibrous material suspension is introduced; and a roll around which said double-screen segment is looped, said roll being a combined forming and draining roll, said roll comprising:

a multitude of suctioning sections, located on an outer surface of said roll, said multitude of suctioning sections further subdivided into a forming sector and a draining sector;

said forming sector comprising a first suctioning section and a second suctioning section extending over a sector of the roll from 20° to 100°, and said forming sector is arranged to immobilize the fibrous material web within said forming sector;

said draining sector, located in a screen run direction behind said forming sector, comprising a plurality of suctioning sections which comprise at least a majority of suctioning sections from said multitude of suctioning sections, wherein said plurality of suctioning sections of said draining sector comprises a first suctioning section, a second suctioning section, and a third suctioning section extending overall over a sector of the roll from 60°–150°, the suctioning capacity of said draining sector becoming greater in the screen run direction from suctioning section to suctioning section, wherein continued draining of the fibrous material web takes place within said draining sector;

one of said two screens of said double-screen segment being an outer screen, said outer screen facing away from said roll being guided so that said outer screen is lifted from the fibrous material web while in said draining sector.

2. The wet section of a machine according to claim 1, one fibrous material web being one of a paper web and a cardboard web.

3. The wet section of a machine according to claim 1, the fibrous material web exhibiting a dry content of at least 10% in the vicinity of its runoff from said roll.

4. The wet section of a machine according to claim 3, the fibrous material web exhibiting a dry content of at least 12% in the vicinity of its runoff from said roll.

5. The wet section of a machine according to claim 1, the outer screen facing away from the roll being lifted from the fibrous material web by a screen guiding roll, said screen guiding roll being constructed so as to be adjustable, in order to adjust a length of said double-screen segment.

6. The wet section of a machine according to claim 1, the fibrous material suspension being introduced by a head box into said double-screen segment, said head box being arranged so that the fibrous material suspension flows out against the force of gravity.

7. The wet section of a machine according to claim 1, a vacuum pressure of 0.6–0.99 bar absolute being applied to the first suctioning section of said plurality of suctioning sections of said draining sector, a vacuum pressure of 0.3–0.7 bar absolute being applied to the second suctioning section of said plurality of suctioning sections of said draining sector, and a vacuum pressure of 0.2–0.4 bar absolute being applied to the third suctioning section of said plurality of suctioning sections of said draining sector.

8. The wet section of a machine according to claim 1, wherein the first suctioning section, the second suctioning section, and the third suctioning section of the draining sector extend overall over a sector of the roll from 70°–90°.

9. The wet section of a machine according to claim 1, a vacuum pressure of 0.7 to 0.99 bar absolute being applied to the first suctioning section of said forming sector.

10. The wet section of a machine according to claim 1, a jacket of said roll being constructed as a reservoir for water extracted from at least one of the fibrous material suspension and the fibrous material web.

11. The wet section of a machine according to claim 10, said roll being equipped with a suctioning unit which produces an air volume flow which is sufficient to suction essentially all the water which is extracted through an inner screen from at least one of the fibrous material suspension and the fibrous material web into said jacket of the roll.

12. The wet section of a machine according to claim 11, said suctioning unit diverting the air volume flow to both front ends of the roll.

13. The wet section of a machine according to claim 1, said roll not exhibiting its own drive.

14. The wet section of a machine according to claim 1, at least one forming strip, which may be pressed against an outer screen facing away from said roll in a flexible manner, being arranged in said forming sector.

15. The wet section of a machine according to claim 14, said at least one forming strip being arranged on said outer screen opposite said forming sector of said roll.

16. The wet section of a machine according to claim 14, a row of about 3 to 15 forming strips being arranged over said forming sector in distribution.

17. The wet section of a machine according to claim 14, a row of about 5 to 8 forming strips being arranged over said forming sector in distribution.

18. The wet section of a machine according to claim 1, a water collection box being arranged on said outer screen facing away from said roll, said water collection box extending over said entire double-screen segment.

19. The wet section of a machine according to claim 18, another water collection box being arranged on a peripheral section of said roll which is located behind the draining sector.

20. The wet section of a machine according to claim 19, wherein said collection box and said another water collection box are arranged such that the water is collected essentially due to the force gravity alone.

21. The wet section of a machine according to claim 1, the diameter of said roll being greater than 1.5 m.

22. The wet section of a machine according to claim 1, the diameter of said roll being greater than 2 m.

23. The wet section of a machine according to claim 1, at least one extended-nip press device in said draining sector being arranged on said outer belt, which is facing away from said roll.

24. The wet section of a machine according to claim 23, said at least one extended-nip press device exhibiting a shoe press roll, a mating roll of which is said roll.

25. The wet section of a machine according to claim 24, said outer screen being looped around said shoe press roll, such that it is lifted from the fibrous material web.

26. The wet section of a machine according to claim 24, said shoe press roll being arranged behind said double-screen segment on said roll with respect to the screen run direction.

27. The wet section of a machine according to claim 26, a belt being looped around said shoe press roll, the fibrous material web being removed from an inner screen of the double-screen segment, the inner screen facing said roll.

28. The wet section of a machine according to claim 26, a belt being looped around said shoe press roll, said belt being removable from the fibrous material web just behind said shoe press roll, the fibrous material web behind said shoe press roll being removable from an inner screen of the double-screen segment, the inner screen facing said roll.

29. The wet section of a machine according to claim 23, no further press devices being provided between a runoff point of the fibrous material web from said roll and a transfer point to a drying section.

30. A process for the manufacture of a fibrous material web comprising:

guiding two screens in a double-screen segment parallel to each other and around a roll comprising a multitude of suctioning sections located on an outer surface of said roll, one of said two screens being an outer screen facing away from said roll;

introducing a fibrous material suspension into the double-screen segment;

immobilizing the fibrous material suspension on the roll in the double-screen segment for the formation of a fibrous material web, the immobilization occurring in a forming sector of the roll, said forming sector comprising a first suctioning section and a second suctioning section extending over a sector of the roll from 20° to 100°;

draining the fibrous material web further, at least a predominant part of the draining occurring in a draining sector of the roll, the draining sector being located in a screen run direction behind the forming sector, said draining sector comprising a plurality of suctioning sections which comprise at least a majority of suctioning sections from said multitude of suctioning sections, wherein said plurality of suctioning sections of said draining sector comprises a first suctioning section, a second suctioning section, and a third suctioning section extending overall over a sector of the roll from 60°–150°, the suctioning capacity of said draining sector becoming greater in the screen run direction from suctioning section to suctioning section; and guiding said outer screen so that the outer screen is lifted from the fibrous material web while in said draining sector.

31. The process according to claim 30, the fibrous material web comprising one of a paper web and a cardboard web.

32. The process according to claim 30, comprising manufacturing graphic papers with a basis weight of about 30 to 110 g/m$^2$.

* * * * *